US007842866B1

(12) United States Patent
Atkinson

(10) Patent No.: US 7,842,866 B1
(45) Date of Patent: Nov. 30, 2010

(54) MUSICAL INSTRUMENT

(76) Inventor: Wooster Leroy Atkinson, 1944 Dog Island Rd., Bishopville, SC (US) 29010

( * ) Notice: Subject to any disclaimer, the term of this patent is extended or adjusted under 35 U.S.C. 154(b) by 94 days.

(21) Appl. No.: 12/266,832

(22) Filed: Nov. 7, 2008

(51) Int. Cl.
*G10D 3/00* (2006.01)

(52) U.S. Cl. ..... 84/290

(58) Field of Classification Search ..... 84/290, 84/285, 192; D17/14; D21/405
See application file for complete search history.

(56) References Cited

U.S. PATENT DOCUMENTS 3,375,747 A * 4/1968 Posey ..... 84/453
4,028,977 A 6/1977 Ryeczek
7,317,157 B2 1/2008 Cslovjecsek

FOREIGN PATENT DOCUMENTS

JP 2002268654 A * 9/2002

OTHER PUBLICATIONS

Photo found at http://joyvictory.wordpress.com/2007/07/singing.jpg dated Feb. 19, 2009.

* cited by examiner

*Primary Examiner*—Jianchun Qin
(74) *Attorney, Agent, or Firm*—Daniel C. Leonardi; Michael A. Mann; Nexsen Pruet, LLC

(57) ABSTRACT

A musical instrument having a body shaped like a traditional stringed instrument such as a guitar and a sounding piece for strumming. The sounding piece, which is made of a material sufficiently stiff as to emit a sound when strummed, has a plurality of corrugations. The sounding piece is mounted within or on the body so that the corrugations run parallel to the longitudinal axis of the body. The sounding piece is also mounted sufficiently loosely within or on the body that it is able to vibrate sufficiently freely as to make a sound.

12 Claims, 3 Drawing Sheets

MUSICAL INSTRUMENT

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not Applicable.

BACKGROUND OF THE INVENTION

Since the beginning of recorded history people have enjoyed making and listening to music. The power of music to inspire people is unmatched by any other artistic medium. At the same time, however, musical instruments, particularly stringed musical instruments, are difficult to play. The vast majority of people that set out to learn to play a musical instrument abandon their efforts before reaching any reasonable level of proficiency. Furthermore, learning to play a musical instrument can be even more difficult for individuals with physical or mental disabilities that make complex fingering and strumming even more challenging. Accordingly, there exists a need for a musical instrument that is easily held and played thereby enabling anyone to enjoy the experience of joining with other musicians to make music.

SUMMARY OF THE INVENTION

The present invention is a musical instrument comprised of a body and a sounding piece. The body can be shaped like a musical instrument, such as a guitar or other stringed instrument. The sounding piece, which is carried by the body, can be corrugated so that when the musician strums the sounding piece, a sound is created. The sounding piece is carried by the body sufficiently loosely that it is able to vibrate and produce a sound.

DETAILED DESCRIPTION OF THE EMBODIMENTS

The present invention is a musical instrument and, specifically, a percussive musical instrument that is easy for anyone to hold and play.

Figure 1:
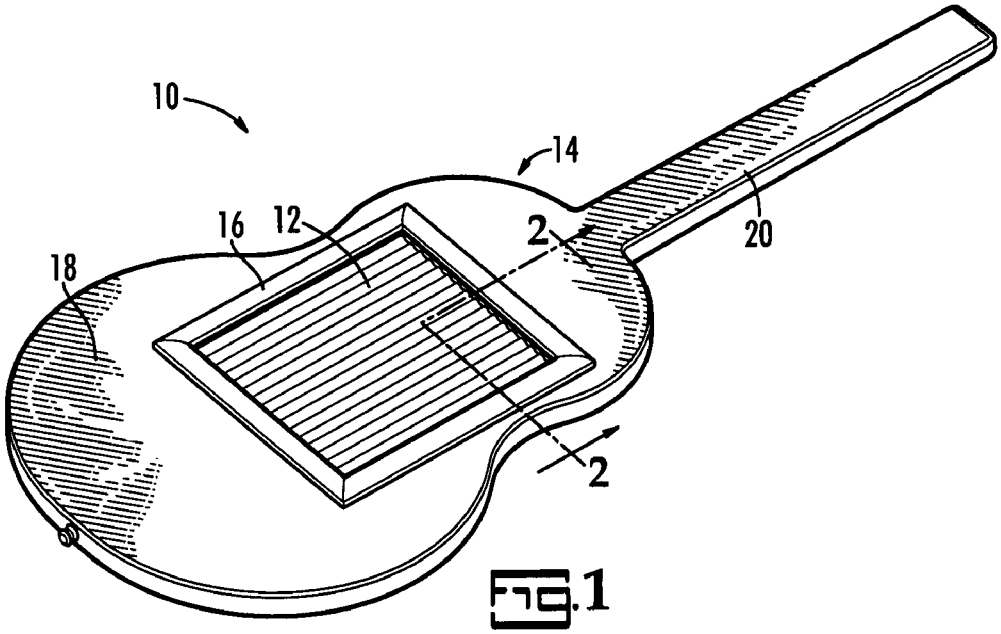
FIG. 1 is a perspective view of one embodiment of the present invention.

Referring first to FIG. 1, the musical instrument of the present invention 10 is generally comprised of a body 14 and a sounding piece 12. In this particular embodiment, the body 14 is shaped like an acoustic guitar and includes a neck 20, although the body 14 could be shaped like the body of any stringed instrument. The sounding piece 12 is carried by the body 14. The body 14 carries the sounding piece 12 sufficiently loosely that the sounding piece is able to vibrate when strummed to produce a sound. In this particular embodiment, sound piece 12 is carried within the body 14 and is retained within the body 14 by frame 16, which is attached to the front face 18 of the body 14. A musician holds body 14 like an acoustic guitar and strums the sounding piece 12 much like the musician would strum the strings of an acoustic guitar. The shape of body 14 makes the instrument particularly easy to hold, especially if the edge of the body is rested on the musician's leg or in the musician's lap.

Figure 2:
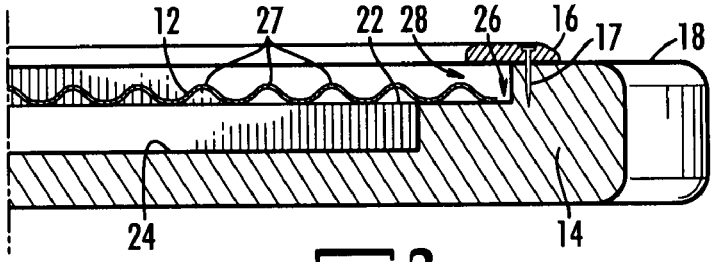
FIG. 2 is a partial cross sectional view of one embodiment of the present invention taken at section line 2-2 in FIG. 1 showing the sounding piece resting on a shelf within the body.

FIG. 2 is a partial cross sectional view of the musical instrument of the present invention taken at section 2-2 of FIG. 1. FIG. 2 shows that sounding piece 12 has corrugations 27 and is carried by body 14 in a recess 24. Note that the corrugations 27 run parallel to the longitudinal axis of the body 14. This make is easy for a musician to strum the sounding piece 12 as if it were guitar strings.

In further reference to the particular embodiment of the present invention show in FIG. 2, the recess 24 in which the sounding piece 12 resides has a shelf 22 to support the edges of the sounding piece 12. In this particular embodiment, shelf 22 is integral to body 14. Shelf 22, however, could also be a separate piece that is attached to body 14 within recess 24. Frame 16, which is attached to the front face 18 of body 14, retains the sounding piece 12 within the body 14.

It is important to note that although FIG. 2 shows that frame 16 is attached to the front face 18 of body 14 with a nail 17, any means of attachment known in the art (e.g., glue, screws, etc.) could be used to attach frame 16 to the front face 18 of the body 14. Likewise, although this embodiment shows a frame 16 being used to retain sounding piece 12 in the body 14, any means of retention known in the art could be used to retain sounding piece 12.

If the sounding piece 12 were rigidly attached to the body 14, such attachment would dampen the vibration of the sounding piece 12 and prevent the instrument from working properly. Accordingly, sounding piece 12 is not rigidly attached to body 14. Note that there is space 26 between the edge of the sounding piece 12 and the body 14 as well as space 28 between the crests of the corrugations 27 and the frame 16. These spaces 14 and 28 permit the sounding piece 12 to vibrate within the body 14 and produce a sound when strummed by the musician.

Figure 3:
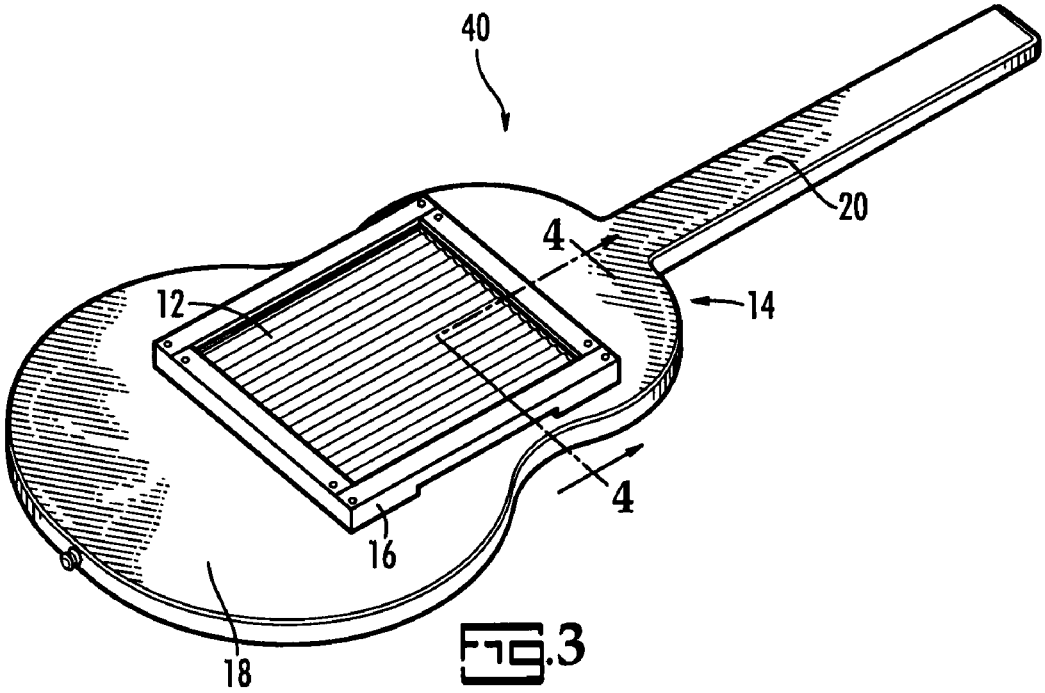
FIG. 3 is an alternative embodiment of the present invention.
Figure 4:
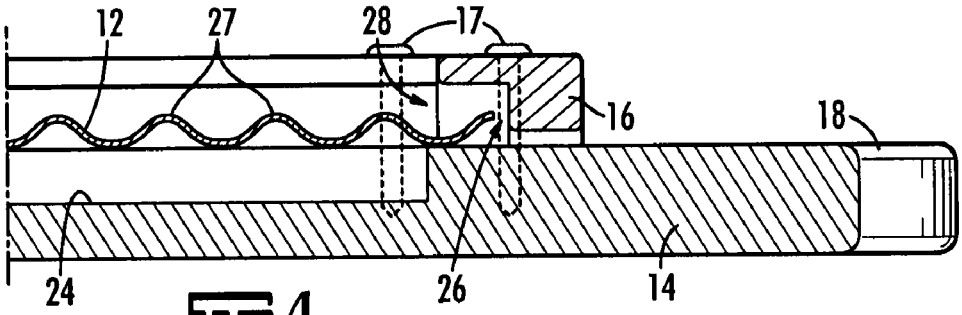
FIG. 4 is a cross sectional view of an alternative embodiment of the present invention taken at line 4-4 of FIG. 5 wherein the sounding piece is positioned between a frame and the outside surface of the body.
Figure 5:
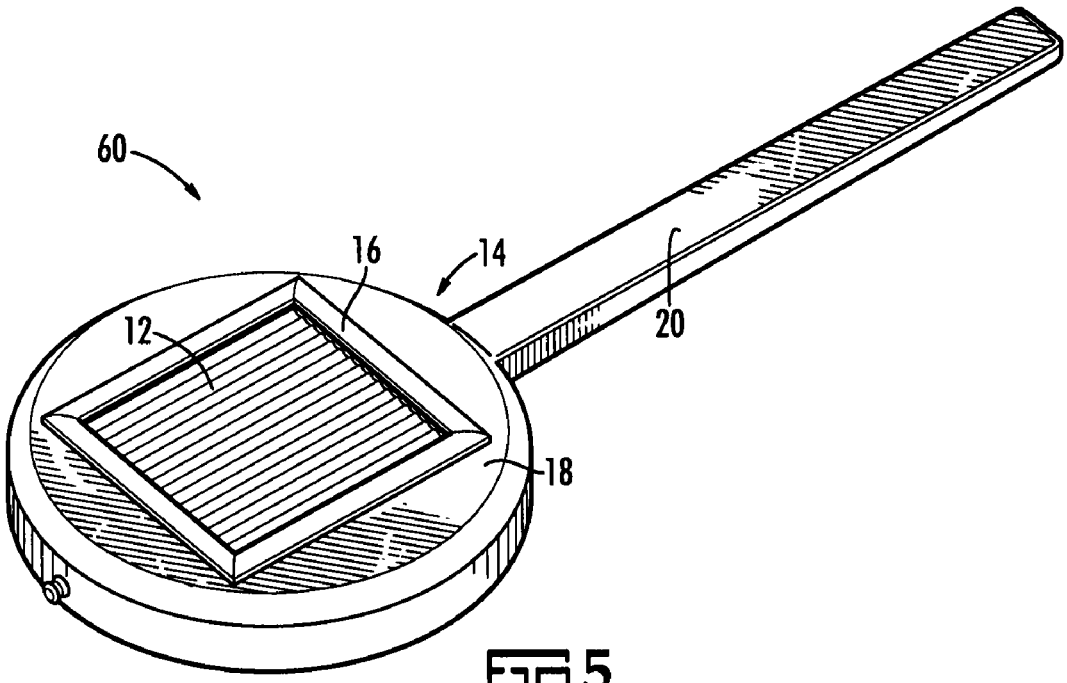
FIG. 5 is an alternative embodiment of the present invention wherein the body is shaped like a banjo.

FIG. 3 is another embodiment of the present invention 40 wherein the sounding piece 12 is carried on the face 18 of the body 14. Again, a frame 16 is used to retain the sounding piece 12. FIG. 4 is a cross sectional view of the embodiment 40 of the present invention shown in FIG. 3 and is taken at section 4-4 in FIG. 3. FIG. 4 shows that, like in the embodiment 10 shown in FIG. 1, the sounding piece 12 is carried on the body 14 loosely. Specifically, spaces 26 and 28 are maintained between the edge of the sounding piece 12 and the frame 16 and the crests of the corrugations 27 of the sounding piece 12 and the frame 16, respectively. These spaces 26 and 28 ensure that sounding piece 12 is not unduly dampened when the musician strums the sounding piece 12. Furthermore, recess 24 also ensures that sounding piece 12 has sufficient room to vibrate and make a sound when strummed. FIG. 5 is an alternative embodiment 60 of the present invention wherein the body 14 is shaped like the body of a banjo.

Those skilled in the art of musical instrument making will recognize that many substitutions and modifications can be made in the foregoing embodiments without departing from the spirit and scope of the present invention.

What is claimed is:

1. A musical instrument comprising:

a body shaped like a stringed instrument and having a longitudinal axis;

a sounding piece, said sounding piece having a plurality of corrugations, said corrugations running parallel to said longitudinal axis of said body; said sounding piece being loosely carried by said body without screws attaching said sounding piece to said body so that when a musician holds said body and strums said corrugations of said sounding piece, said sounding piece vibrates within said body creating a sound.

2. The musical instrument of claim 1 wherein said body is shaped like a guitar body.

3. The musical instrument of claim 1 wherein said body is shaped like a banjo body.

4. The musical instrument of claim 1 wherein said body is made of wood.

5. The musical instrument of claim 1 wherein said body is made of plastic.

6. The musical instrument of claim 1 wherein said sounding piece is made of metal.

7. The musical instrument of claim 1 further comprising:

a shelf within said body; and an outer retaining frame attached to said body;

wherein said sounding piece is carried between said shelf and said outer retaining frame and said outer retaining frame retains said sounding piece within said body.

8. The musical instrument of claim 1 wherein said sounding piece is made of plastic.

9. The musical instrument of claim 7 wherein said shelf is integral to said body.

10. A musical instrument comprising:

a body shaped like an acoustic guitar and defining a longitudinal axis; and a sounding piece carried loosely by said body without screws attaching said sounding piece to said body, said sounding piece positioned substantially where the sound hole would be if said body were an acoustic guitar, said sounding piece having a plurality of corrugations, said corrugations running parallel to said longitudinal axis so that a player can hold said body as said player would hold said acoustic guitar and strum said plurality of corrugations as said player would strum said acoustic guitar.

11. The musical instrument of claim 10 further comprising:

an outer retaining frame attached to said body;

wherein said sounding piece is loosely carried between said body and said outer retaining frame, said outer retaining frame loosely retaining said sounding board within said body.

12. A musical instrument comprising:

a body shaped like a guitar or banjo, said body having a longitudinal axis and a recess;

a sounding piece having an outer edge and corrugations running parallel to said longitudinal axis;

an outer retaining frame attached to said body around said recess so that said outer retaining frame alone retains said sounding piece within said recess;

wherein said recess, said sounding piece, and said frame are dimensioned so that said sounding piece is loosely carried within said recess with space between said edge of said sounding piece and said body and with space between said corrugations and said outer retaining frame so that, when a musician holds said body and strums said corrugations of said sounding piece, said sounding piece vibrates within said body creating a sound.

* * * * *